US006585247B2

(12) United States Patent
Mattox et al.

(10) Patent No.: US 6,585,247 B2
(45) Date of Patent: Jul. 1, 2003

(54) TENSIONING DEVICE, IN PARTICULAR A MACHINE VICE WITH A QUICK-TENSION MEANS

(75) Inventors: James R. Mattox, Rockford, IL (US); Rudolf Henkel, Ronsberg (DE)

(73) Assignee: Fa. Georg Kesel GmbH & Co. KG, Kempten (DE)

( * ) Notice: Subject to any disclaimer, the term of this patent is extended or adjusted under 35 U.S.C. 154(b) by 30 days.

(21) Appl. No.: 09/858,405

(22) Filed: May 16, 2001

(65) Prior Publication Data

US 2002/0005609 A1 Jan. 17, 2002

(30) Foreign Application Priority Data

May 23, 2000 (DE) ..... 100 25 402

(51) Int. Cl.[7] ..... B25B 1/10
(52) U.S. Cl. ..... 269/244; 269/43
(58) Field of Search ..... 269/244, 283, 269/279–284, 136, 256, 134, 261, 258, 93, 43

(56) References Cited

U.S. PATENT DOCUMENTS

| | | | | |
|---|---|---|---|---|
| 2,846,907 A | | 8/1958 | Sprink | 81/17 |
| 4,706,949 A | * | 11/1987 | Dossey et al. | 269/283 |
| 5,163,662 A | * | 11/1992 | Bernstein | 269/136 |
| 5,374,040 A | * | 12/1994 | Lin | 269/43 |
| 5,553,838 A | * | 9/1996 | Lee | 269/93 |
| 5,799,933 A | * | 9/1998 | Yang | 269/261 |

FOREIGN PATENT DOCUMENTS

| | | |
|---|---|---|
| DE | 7215612 | 8/1972 |
| DE | 2155806 | 5/1973 |
| DE | 2326546 | 12/1974 |
| DE | 2928167 | 1/1981 |
| DE | 2909451 | 6/1982 |
| DE | 4018284 | 4/1991 |

* cited by examiner

*Primary Examiner*—Lee D. Wilson
(74) *Attorney, Agent, or Firm*—Notaro & Michalos P.C.

(57) ABSTRACT

The invention relates to a tensioning device, in particular a machine vice, with a base body, with a stationary jaw attached thereto and with a movable jaw opposite this, for whose adjustment there is provided a tension rod, wherein the tension rod comprises a support bearing via which the movable jaw is supported by way of a compression rod. The object of the invention is to specify a tensioning device which permits a quick tensioning also of differently dimensioned subjects and furthermore offers the largest possible protection from contamination of the functional parts. This object is achieved in that the movable jaw is formed lockable at various distances to the stationary jaw with the compression rod, preferably by way of clamping bodies.

21 Claims, 5 Drawing Sheets

TENSIONING DEVICE, IN PARTICULAR A MACHINE VICE WITH A QUICK-TENSION MEANS

BACKGROUND OF THE INVENTION

The invention relates to a tensioning device, in particular for a machine vice, with a base body, with a stationary jaw arranged thereon and with a movable jaw opposite this for whose adjustment there is provided a tension rod, wherein the tension rod comprises a support bearing via which the movable jaw is supported by way of a compression rod.

A tensioning device according to this type is known from the German patent document DE-C1 40 18 284.

The patent document describes a machine vice with a force amplifier. The movable jaw is moved to the subject to be tensioned by rotating a sleeve on which there is located an outer thread.

A coaxially mounted spindle actuates subsequently a force amplifier which creates the necessary tensioning force between the stationary and movable jaw.

The movable jaw cooperates with the sleeve as a spindle-nut drive. With this the movable jaw is the nut and the sleeve is the spindle.

With the machining of the subject any occuring swarf may fall downwards onto the thread of the sleeve and thus penetrate into the gap between the movable jaw and the thread of the sleeve. The result of this is an increased wear as well as disturbances on adjusting the movable jaw. Furthermore the application of the movable jaw onto the subject demands a disadvantageous, great time expense since for tensioning firstly by way of rotating the sleeve the movable jaw must be traversed onto the subject.

BRIEF SUMMARY OF THE INVENTION

It is the object of the invention to specify a tensioning device which permits a quick tensioning also of differently dimensioned subjects and furthermore offers a largest possible protection from contamination of the functional parts.

This object is achieved with a tensioning device of the known type in that the movable jaw is designed lockable at various distances to the stationary jaw with the compression rod, preferably lockable by way of a clamping body. The locking may again be easily released and after a subject change may again be locked in a new position. By way of a subsequent rotation of the tension rod which with its thread for example engages into a nut of the base body, the subject may be tensioned in the shortest of times. The locking may also advantageously be effected by clamping bodies which are formed in the manner of a free-wheel. By way of a suitable actuating device the position of the clamping body may be changed such that the locking of the movable jaw may be released again in order to change the distance to the stationary jaw arbitrarily.

Advantageously the locking may also be formed with a positive fit when the compression rod comprises catching surfaces into which counter-surfaces of the movable jaw or its movable carrier element are engagingly arranged. The movable jaw after releasing the catching may be easily pushed onto the subject so that there is given a quick adjustability of the jaw.

After a renewed catching the jaw may be finely adjusted and the necessary tensioning pressure may be mustered by rotating the tension rod or by actuation of a suitable hydraulic or pneumatic cylinder.

The catching of the functional parts is effected between the movable jaw and the compression rod or between its movable transport element and the compression rod.

The compression rod at the same time essentially retains its relative position to the tension rod. For the quick adjusting thus the movable jaw or its movable transport element is adjusted relative to the compression rod.

The compression rod may simultaneously protect the tension rod from contamination when the compression rod is formed as a sleeve which at least partly envelops the tension rod. The tension and compression rod are at the same time coaxially mounted.

The operation of the tensioning device is simplified in that for the sleeve there is provided a tensioning position in which the movable jaw or its carrier element is supported via the sleeve on the tension rod, and there is provided an adjusting position in which the movable jaw is designed displaceable relative to the base body. At a certain angular position there arises a frictional connection, prefereably also a positive-fit connection, between the sleeve and the movable jaw or its carrier element.

In another angular position into which the sleeve may be brought by rotation about its longitudinal axis, this frictional connection, preferably also positive-fit connection is released so that the movable jaw or its carrier element may be displaced relative to the base body.

The frictional and positive-fit connection of the sleeve and the jaw may be achieved in that on the sleeve there is provided at least one support surface as a catch surface which is preferably formed as a web.

If the movable jaw or its movable carrier element comprises channels adapted to the web then the force transmission from the jaw or its movable carrier element is effected via the channels onto the web of the sleeve.

The selective switching of a possible frictional connection or the releasing of the frictional connection is with regard to design made particularly simply in that the collar is only provided at one part of the sleeve circumference.

By rotating the collar the webs may rise out of the channels since the carrier part below comprises a longitudinal slot which is wider than the side surfaces of the web.

With this rotation any swarf located on the sleeve is moved from the spindle upper side into the inner space of the base body, thus away from the spindle.

The sleeve is simultaneously advantageously guided in the movable jaw or in its carrier parts in that the recess below comprises a longitudinal slot which is wider than the web of the sleeve.

A particularly comfortable adjustment in order to bring the sleeve out of the tensioning position into the movable adjusting position may be achieved when the sleeve is rotatably mounted about its longitudinal axis.

The installation of the movable jaw or its movable carrier element and the manufacture of the engagement of the webs into the channel profile is achieved by way of the measure that the movable carrier element has a symmetrical channel profile for the engagement of the webs of the sleeve.

The tensioning width may be advantageously changed by way of a 180° rotated installation of the movable jaw on its carrier element. For this however the carrier element is provided with a fastening profile for the movable jaw, which itself is formed non-symmetrically to the channel profile. By rotating the movable carrier element together with the jaw by 180 degrees in the horizontal, the tensioning range of the tensioning device may be comfortably adjusted. For similar tensioning regions by way of this the constructional length of the base body may be kept shorter.

A sufficiently high tensioning force for many cases may be achieved when the tension rod is formed as a part of a spindle-nut drive for adjusting the movable jaw, preferably for this comprises an outer thread which is formed engaging into a nut of the stationary jaw or of the base body.

By way of the fact that the nut of the spindle-nut drive is formed of plastic, in many cases one may do away with hydraulic, pneumatic or mechanical force amplifiers.

Advantageously the design manner of the tensioning device however also permits the provision of a hydraulic, pneumatic or mechanical force amplifier, preferably acting on the spindle.

In practice one embodiment form has shown to be particularly successful in which the sleeve has at least one angular position, which is formed catchable, preferably with a friction fit. On operation the thus locked angular position may be differentiated from the position in which the jaw is freely displaceable.

The mustered tensioning force may advantageously be easily controlled when a free end of the spindle comprises a square socket which is formed for receiving a standard torque key. Since such a torque key is present anyway on most shop floors by way of the combination of the quick-adjustment with the spindle-nut drive of the tension rod the tensioning force may be mustered in a comfortable and directed manner. Particular further measures are not required.

Advantageously it is envisaged that at least one jaw, preferably the stationary jaw comprises a holding device, in particular a holding edge. By way of this it is possible to grip the tensioning device at the holding device and to transport it.

The safety on cleaning the tensioning device is advantageously increased in that at least one jaw comprises a cover plate which preferably is fastened with a screw. In the heads of the fastening screws there accumulates swarf which then on blowing out of the tensioning device may injure the operator. By way of the use of a cover plate the fastening screws are covered so that here no dirt may accumulate. Preferably the cover plate is fastened with only one centric screw.

Further dirt accumulation may be advantageously avoided in that the groove is not designed continuous.

The rotating of the sleeve is simplified in that the grip is at least partly knurled. The knurling has furthermore the advantage that it forms a marking. The left end of the knurling before actuation of the tension rod bears flush on the base body. Without the knurling there exists the danger that the operator does not notice that the spindle-nut drive is overwound which has the result that the tension rod is pressed against the lid of the base body. By way of the knurling the operator may much better estimate how much distance there is still present between the lid and the tension rod.

It is advantageously envisaged that in the grip there is incorporated a marking, preferably a flute. This flute is in the basic condition the distance to the base body about which the tension rod may be maximally rotated. If the marking after actuation of the tension rod bears flush on the base body a further rotation of the tension rod need not take place.

One advantageous embodiment of the invention envisages that on the left end of the nut there are arranged disk springs. The tension rod on actuation is pressed against these springs by which means a pressure is exerted onto the tension rod. This pressure build-up is an additional precautionary measure which is to remind the operator that the tension rod is no longer distanced far from the maximal abutment.

By way of the fact that the movable jaw comprises grip windows the displacement of the jaw by hand is simplified.

In order to prevent an excessive force build-up on the subject it is advantageously envisaged that the nut is formed as a sliding clutch. If the build-up tensioning force exceeds a maximum value, the nut slides through, by which means a force limitation takes place.

A constructional simple measure in the design of the sliding clutch lies in setting the nut between two O-rings. The pressing force is matched such that on exceeding the maximal allowable tensioning force a sliding-through of the nut is effected.

The stability of the tensioning device is increased in that the nut is formed of metal, preferably bronze or brass.

The invention is described in a preferred embodiment example by way of example with reference to the drawings, wherein further advantages of the invention may be deduced from the details of the drawings. Parts which with regard to function are the same are provided with the same reference numerals.

DETAILED DESCRIPTION OF THE INVENTION

Figure 1:
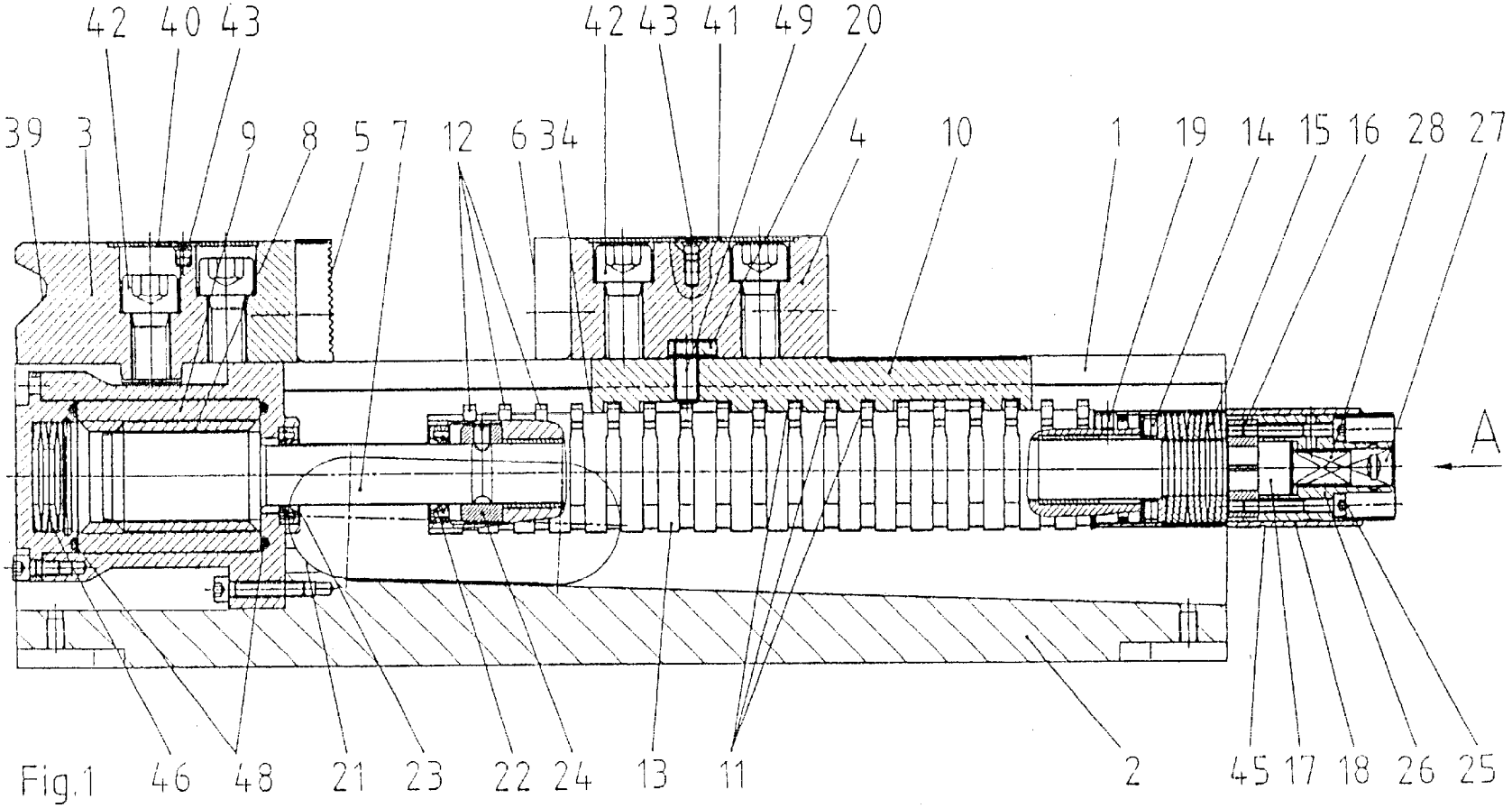
FIG. 1 an axial section through the machine vice according to the invention, FIG. 2, a view according to arrow A in FIG. 1 with 3 various catching positions of the movable jaw.

In FIG. 1, 1 indicates the machine vice according to the invention. It consists of a base body on whose one end there is arranged a stationary tensioning jaw 3. Additionally in the base body 2 there is mounted a movable tensioning jaw 4. A subject which is not shown is tensioned between the tensioning surface 5 and 6 of the tensioning jaws 3 and 4. The tensioning forces which occur with this are accommodated by a tension rod 7.

This tension rod 7 is designed as a spindle whose thread 8 engages into a plastic nut 9 of the base body.

The movable jaw 4 is via a suitable positive-fit connection as a fastening profile rigidly connected to its carrier element 10. The carrier element on the one side comprises channels 11 into which the webs 12 of a sleeve 13 engage. By way of this engagement into the channel profile there also arises a positive-fit connection between the sleeve 13 and the carrier element 10.

The sleeve 13 is for its part axially passed through by the tension rod 7, wherein the sleeve 13 in the region of the free end of the tension rod 7 is supported on this so that the sleeve 13 acts as a compression rod.

Since the sleeve 13 and the tension rod 7 are rotatable relative to one another, between the right, outer end and the sleeve 13 and the spindle 7 there is provided a thrust bearing.

The sleeve 13 is supported thus via the thrust bearing 14 on a disk spring assembly 15 which in turn via the divided support ring 16 is supported on the collar 17 in order to introduce the occuring tensioning forces on the collar 17 into the tension rod 7.

A grip 18 is connected to the sleeve 13 in a rotationally fixed manner by way of pins 19 so that by rotating the grip 18 the angular position of the sleeve 13 may be adjusted.

The tensioning forces engaging on the jaw 4 are thus via pegs 20 transmitted onto the carrier element 10. From here they are transmitted via the stationary-jaw-side surfaces of the channels onto the support surfaces of the webs 12. The sleeve 13 leads these then via the thrust bearing 14 onto the spring assembly 15, support ring 16 and the collar 17 onto the tension rod 7. The flow of force is then from the tension rod 7 closed via the outer thread 8, nut 9 and tensioning jaw 3.

In the intermediate space between the tensioning surfaces 5 and 6 there is laterally provided a swarf exit opening 21 within the vice. By way of a sealing ring 22 the swarf is prevented from entry into the intermediate space between the sleeve and the spindle. The sealing ring 23 prevents the entry of dirt into the gap of the thread between the spindle thread 8 and the nut 9.

An abutment ring 24 which is fastened on the tension rod 7 prevents the axial displacement of the sleeve 13 in the direction of the fixed jaw 3.

At the free end of the tension rod 7 by way of screws 25 there is fastened an adapter ring 26 which has a square socket 27 into which a standard torque key may be inserted. The screws 25 tension the adapter ring 26 rigidly with the divided support ring 16 and fix the adapter ring 26 with the associated square 28 on the tension rod 7 in a rotationally fixed manner.

The fixed jaw comprises a holding device 39 in the form of a holding edge. This simplifies the transport of the tensioning device.

The jaws 3, 4 comprise cover plates 40, 41. These cover the fastening screws 42 of the jaws 3, 4 by which means it is advantageously avoided that here there accumulates swarf. The cover plates 40, 41 are in each case fixed with a centric screw 43.

The groove 44 in which the peg 20 is guided is formed laterally closed. With a continuous groove 44 swarf would accumulate therein.

The grip 18 is knurled. Before actuation of the tension rod 7 the left end of the knurling bears flush on the base body 2. The knurling is displaced by the actuation of the tension rod 7 into the base body 2. By way of the knurling the operator may estimate how far the tension rod 7 has already been traversed into the base body 2.

At a twelve millimeter distance from the left end of the knurling there is incorporated a marking 45 in the form of a flute. As soon as the flute and the base body 2 are flush the maximal allowable screwing-in position of the tension rod in the nut 9 is achieved.

On the left side of the tension rod 7 there are arranged disk springs 46. If the tension rod 7 is screwed far into the nut 9 the tension rod 7 abuts against the springs 46 by which means a pressure is exerted onto the tension rod 7. This pressure build-up serves the operator as a indication that the maximal allowable screwing-in position of the tension rod 7 is achieved.

The nut 9 is formed as a sliding clutch. For this the nut 9 is set between two O-rings 48. If the built-up tensioning force exceeds a maximum value a sliding through of the nut 9 occurs.

Figure 2:
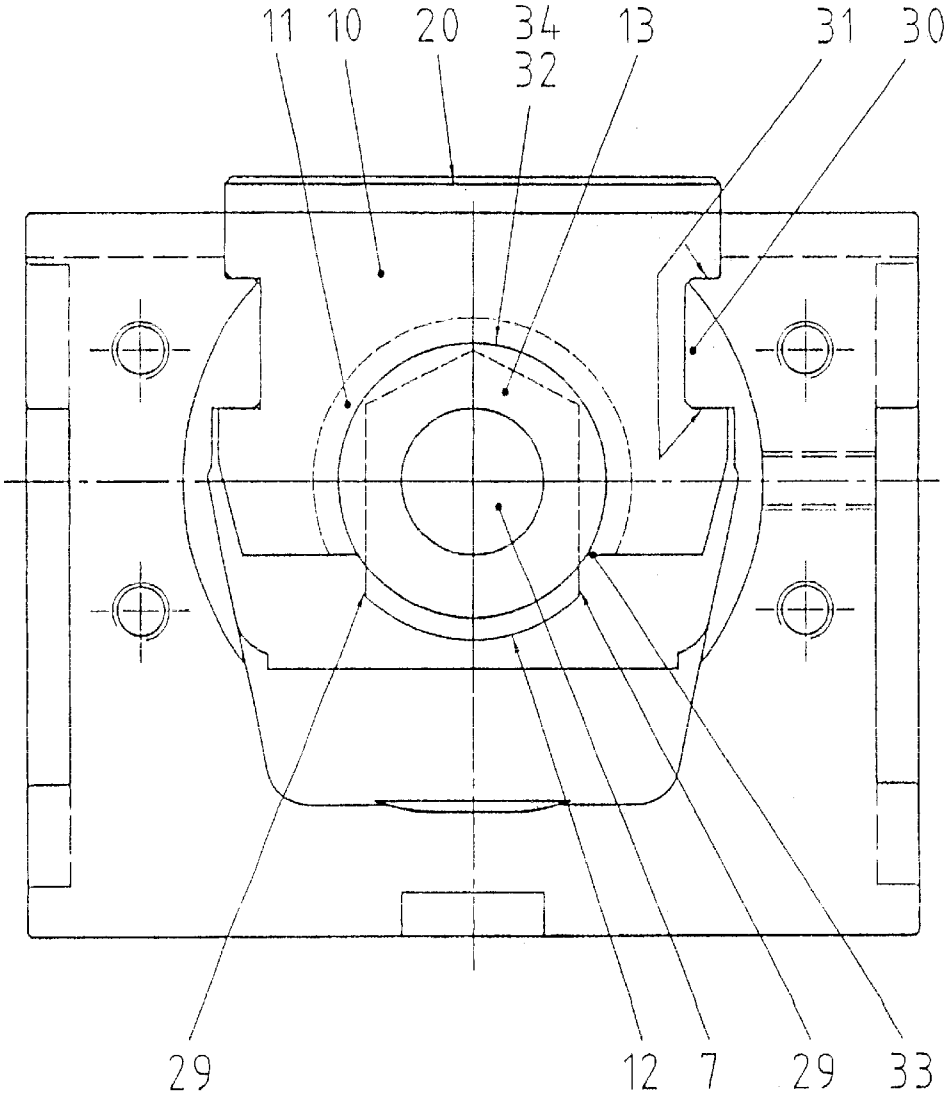

FIG. 2 shows a view of the tensioning device according to the invention from the view according to arrow A in FIG. 1. The spindle 7 is located in the centre. It passes through the sleeve 12 which in FIG. 2 points downwards. The side surfaces of the web 12 are indicated at 29. These continue vertically in the sleeve 13 so that the sleeve comprises deepenings corresponding to the broken lines which here in the region between the webs result is a prismatic outer surface.

These deepenings render the sleeve particularly sensitive to dirt since in these regions the gap to the carrier element 10 becomes particularly large.

The carrier element 10 is led within the base body 2 by way of two lateral guide ledges. The guide ledges 30 engage into a corresponding groove 31 of the carrier element 10.

In the represented position of the web 12 the carrier element 10 may be axially displaced along the guide ledge 30. Any swarf present on the sleeve is conveyed from the edge 34 into the web intermediate spaces. The edge 34 is adapted to the outer contour of the recess for the sleeve in the carrier element. The recess 32 comprises on the lower side a slot 33 which exceeds the width of the web 12. Swarf which has entered in the intermediate space may fall out through this opening of the slot 33. Furthermore in this manner the web 12 is released so that the carrier element 10 is displaceable.

By way of a resilient catch 49 shown in FIG. 1 the vertical position with a manual rotation of the sleeve 13 may be easily found.

Figure 3:
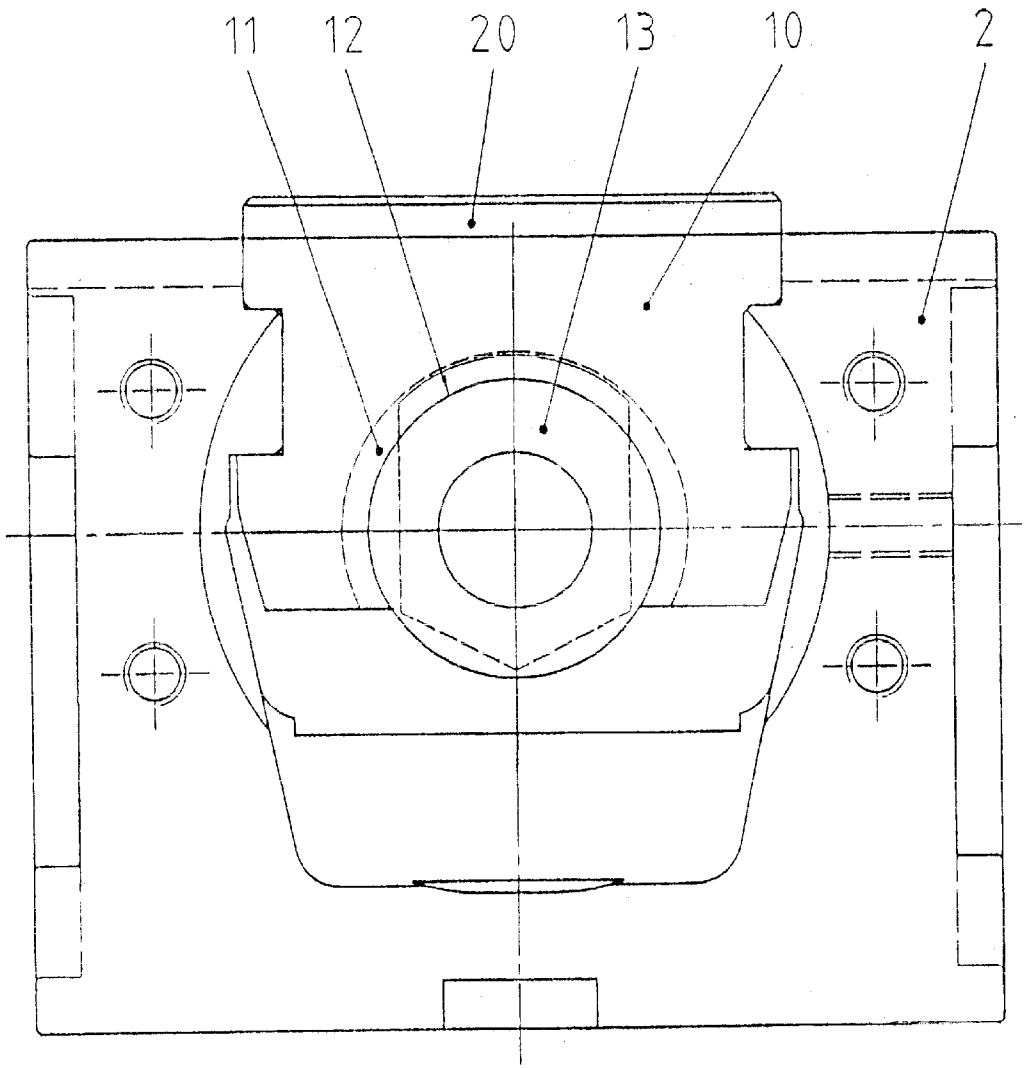
FIG. 3, shows the same view as FIG. 2 in a different position, FIG. 4 a schematic functional sketch of a tensioning device with a clamping body and FIG. 5 a plan view of the movable jaw.

FIG. 3 shows the same view as FIG. 2 but at a position of the sleeve 13 in which the sleeve 13 is locked with the carrier element 10.

For this purpose the sleeve 13 is brought into a position rotated by 180 degrees with respect to FIG. 2. With this rotational movement the web 12 immerses into the channels 11 of the carrier element 10. On account of the prismatic configuration of the web intermediate spaces of the sleeve, any dirt is conveyed by this rotation downwards so that it may fall out through the longitudinal slot 33.

In the position shown in FIG. 3 which likewise is feelably locking to the operating person, there exists a positive-fit between the sleeve and the carrier element 10. By rotating the tension rod 7 there is then effected a fine movement of the movable jaw 4.

The tensioning device according to the invention may be changed in a varied manner within the scope of the invention.

For example instead of the spindle nut 9 also a hydraulic or pneumatic tensioning device may be provided.

However also instead of the spindle-nut drive, mechanical force amplifiers may be applied.

The insertion end for the spindle may also be provided at the other end, or the nut of the spindle may be displaced to the other side of the spindle.

Figure 4:
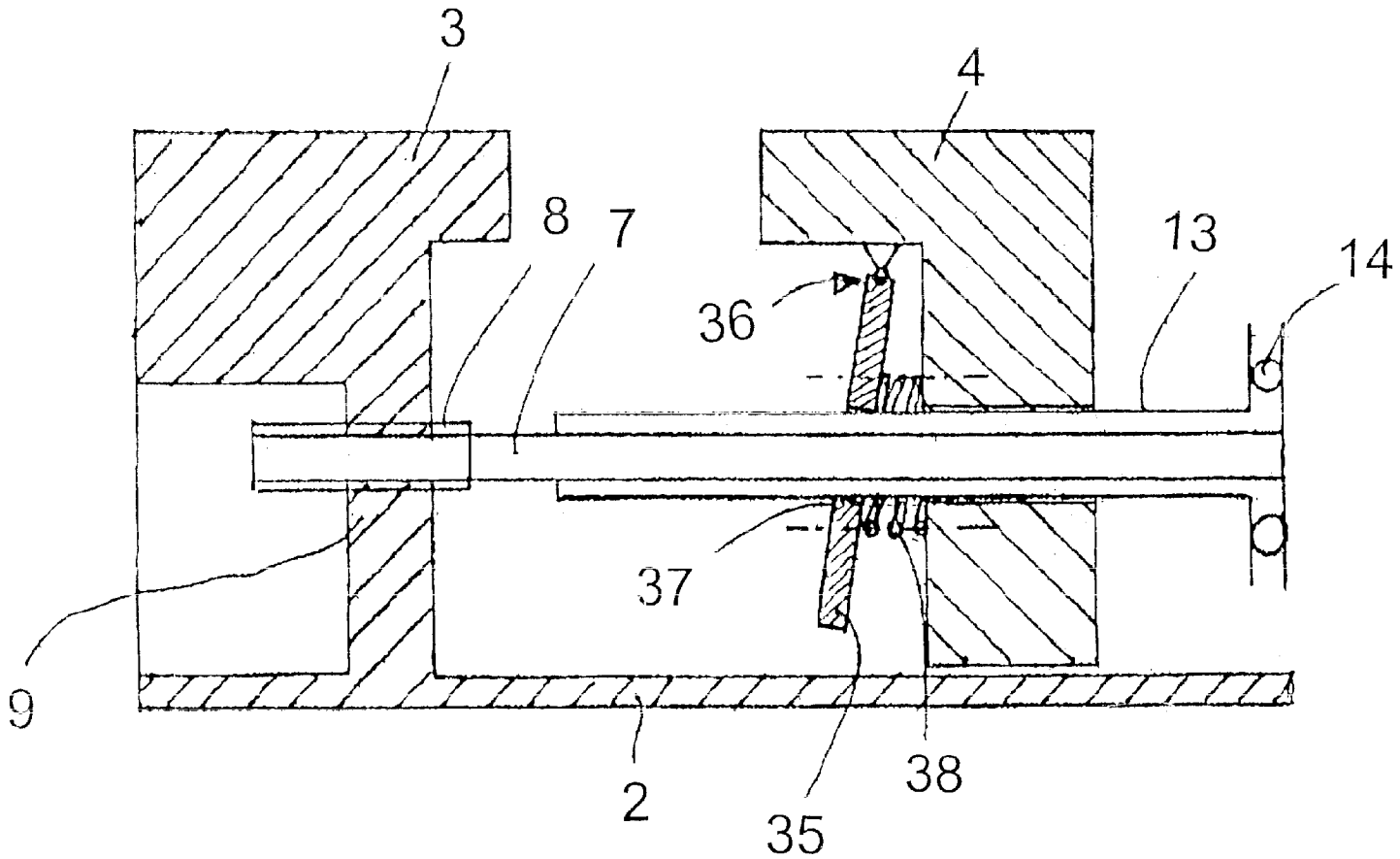

Instead of a positive-fit locking this locking may also be realised also non-positively, for example by way of a clamping body. One possibility is shown in FIG. 4 with which a clamping plate assumes the job of a clamping body. The compression rod 13 is at the same time formed as a sleeve which on the outside however comprises a smooth surface.

If the movable jaw 4 is displaced in the direction of the fixed jaw no clamping takes place. The clamping plate 35 is passed through by the sleeve 3. On displacing, the plate may pivot about the pivot bearing 36 against the compression force of the spring in the direction of the movable jaw so that there arises sufficient play for the sleeve 13 in the opening 37 of the clamping plate in order to be able to displace the plate on the sleeve.

On displacing in the opposite direction as a result of the force of the spring 38 the plate chocks on the sleeve so that the movable jaw is locked on the sleeve 13.

The locking may be released in that the plate 35 is moved against the force of the spring in the direction of the movable jaw by hand or by way of other suitable actuating devices. In this condition the distance of the jaws may be freely changed.

In this manner a universally applicable tensioning device may be created which permits a quick adaptation of the tensioning width to the subject to be tensioned and furthermore is particularly insensitive to dirt with respect to the changing conditions of application in the manufacturing operation.

Figure 5:
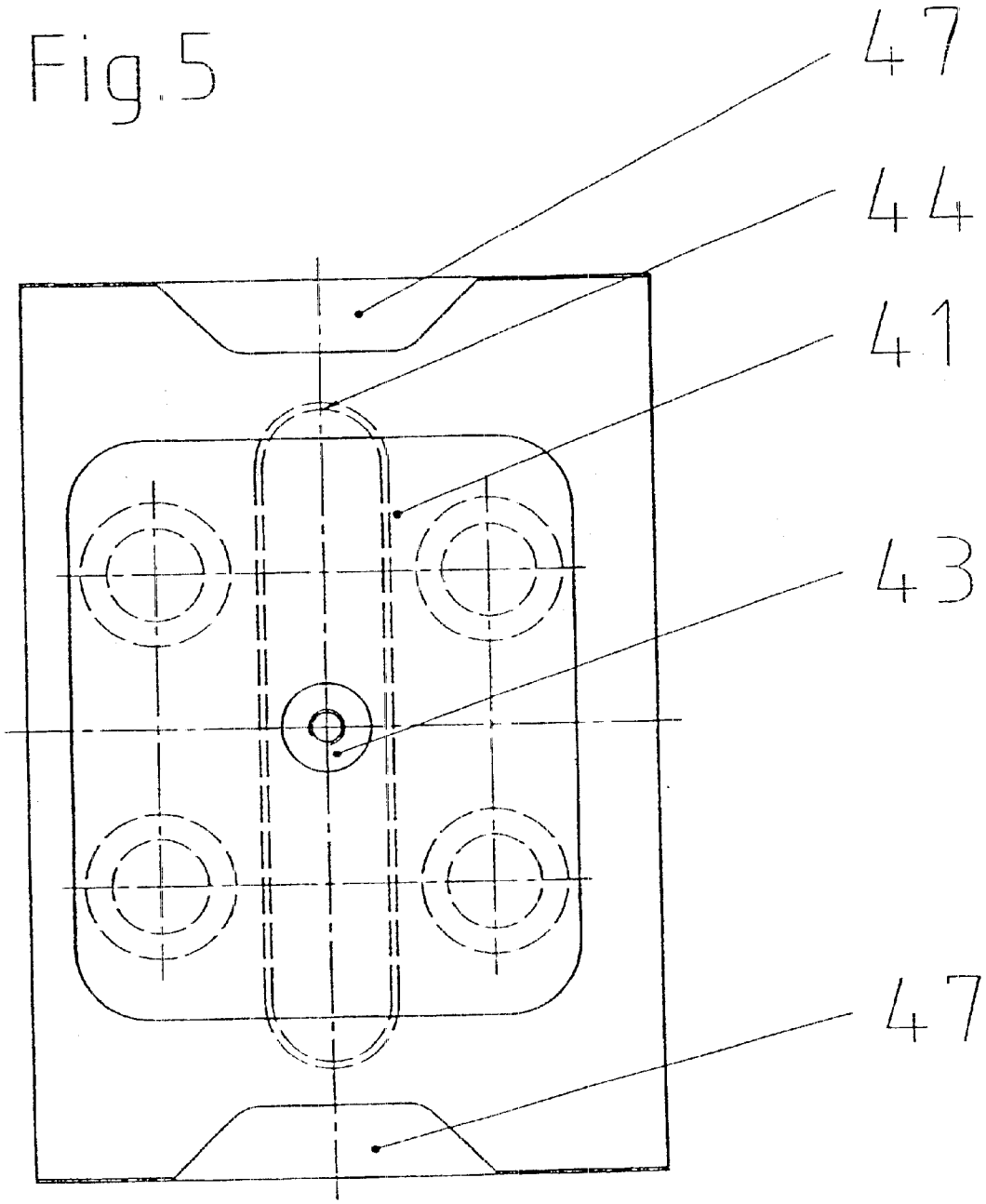

In FIG. 5 there is shown a plan view of the movable jaw 3. On both sides of the jaw there are incorportated grip windows 47 which permit a simple displacing of the jaw 3. The cover plate 41 is fixed by a central screw 43. The groove 44 is not formed continuous but is closed at the sides.

List of Reference Numerals

1 machine vice
2 base body
3 fixed jaw
4 movable jaw
5 tensioning surface
6 tensioning surface
7 tension rod
8 thread
9 nut
10 carrier element
11 channel
12 web
13 sleeve, compression rod
14 thrust bearing
15 disk spring assembly
16 support ring
17 collar
18 grip
19 pin
20 peg
21 swarf exit opening
22 sealing ring
23 sealing ring
24 abutment
25 screw
26 adapter ring
27 square socket
28 square
29 side surface
30 guide ledge
31 groove
32 recess
33 slot
34 edge
35 clamping plate
36 pivot bearing
37 opening
38 compression spring
39 holding device
40 cover plate
41 cover plate
42 fastening screw
43 centric screw
44 groove
45 marking
46 disk springs
47 grip window
48 O-rings
49 resilient catch

What is claimed is:

1. A tensioning device, comprising:

a base body;

a stationary jaw connected to the base body;

a movable jaw attached to the base body opposite the stationary jaw;

a tension rod mounted to the base body and engaged to the movable jaw for adjusting the movable jaw;

a compression rod having a longitudinal axis and defining a sleeve at least partly enveloping the tension rod, the tension rod defining a support bearing for the movable jaw by which support bearing the movable jaw is supported by the compression rod on the base body;

the compression rod having catch surfaces into which counter surfaces of the movable jaw are engaged;

the movable jaw being lockable at a plurality of distances from the stationary jaw with the compression rod; and the compression rod sleeve having a tensioning position in which the movable jaw is supported on the tension rod via the sleeve, and an adjusting position in which the movable jaw is displaceable relative to the base body, the sleeve being rotatably mounted about its longitudinal axis.

2. The tensioning device according to claim 1, including at least one support surface formed as a web on the sleeve and acting as a catch surface.

3. The tensioning device according to claim 2, wherein the movable jaw comprises a channel for receiving the web.

4. The tensioning device according to claim 3, wherein the movable jaw includes a movable carrier element, the carrier element having a fastening profile for the movable jaw, which fastening profile is formed non-symmetrically to a profile of the channel.

5. The tensioning device according to claim 2, wherein the web is only provided on one part of a circumference of the sleeve.

6. The tensioning device according to claim 2, wherein the movable jaw has a recess in which the sleeve is accommodated.

7. The tensioning device according to claim 2, wherein the movable jaw includes a carrier and the carrier comprises a longitudinal slot which is wider than side surfaces of the web.

8. The tensioning device according to claim 2, wherein the movable jaw includes a carrier, the carrier having a symmetrical channel profile for engagement of the web of the sleeve.

9. The tensioning device according to claim 1, wherein the tension rod is formed as part of a spindle-nut drive for adjusting the movable jaw and comprises an outer thread which is formed to engage into a nut of the stationary jaw or of the base body.

10. The tensioning device according to claim 9, wherein the nut of the spindle-nut drive is formed of plastic.

11. The tensioning device according to claim 9, including a hydraulic, a pneumatic or a mechanical force amplifier acting on the spindle-nut drive.

12. The tensioning device according to claim 9, wherein the sleeve has at least one angular position which is non-positively lockable.

13. The tensioning device according to claim 9, wherein a free end of the spindle-nut drive comprises a square socket which is adapted to accommodate a torque key.

14. The tensioning device according to claim 9, including disk springs engaged against the nut.

15. The tensioning device according to claim 9, wherein the nut is formed as a sliding clutch.

16. The tensioning device according to claim 9, wherein the nut is set between two O-rings.

17. The tensioning device according to claim 9, wherein the nut is formed of metal.

18. The tensioning device according to claim 1, wherein at least one of the jaws includes a cover plate fastened with a screw.

19. The tensioning device according to claim 1, wherein the tensioning rod has a grip that is at least partly knurled.

20. The tensioning device according to claim 19, including a marking on the grip.

21. The tensioning device according to claim 1, wherein the movable jaw has grip window.

* * * * *